United States Patent [19]

Reil

[11] Patent Number: 4,564,139

[45] Date of Patent: Jan. 14, 1986

[54] PACKAGING MEANS FOR FILLING MATERIALS WHICH ARE CAPABLE OF FLOW, HAVING A RE-CLOSABLE OPENING MEANS

[75] Inventor: Wilhelm Reil, Bensheim, Fed. Rep. of Germany

[73] Assignee: Tetra Pak Developpement S.A., Pully, Switzerland

[21] Appl. No.: 481,634

[22] Filed: Apr. 4, 1983

[30] Foreign Application Priority Data

May 7, 1982 [DE] Fed. Rep. of Germany ..... 3217156

[51] Int. Cl.[4] ..... B65D 3/10

[52] U.S. Cl. ..... 229/5.5; 222/530; 264/259

[58] Field of Search ..... 229/4.5, 5.5, 43; 222/529, 530, 541; 220/90.4; 264/259

[56] References Cited

U.S. PATENT DOCUMENTS

| | | | |
|---|---|---|---|
| 2,661,128 | 12/1953 | Rieke | 222/530 |
| 2,750,093 | 6/1956 | Moore | 229/5.5 |
| 3,498,521 | 3/1970 | Gill | 229/5.5 |
| 3,613,966 | 10/1971 | Summers | 222/529 |
| 3,988,413 | 10/1976 | Gaudet et al. | 264/259 |
| 4,267,957 | 5/1981 | Holmström | 229/37 R |

FOREIGN PATENT DOCUMENTS

| | | | |
|---|---|---|---|
| 1277256 | 6/1972 | United Kingdom | 222/529 |
| 1389533 | 4/1975 | United Kingdom . | |

*Primary Examiner*—Francis S. Husar
*Assistant Examiner*—Linda McLaughlin
*Attorney, Agent, or Firm*—Fred A. Keire

[57] ABSTRACT

A fluid packaging arrangement comprises tubular side walls and end walls disposed at the ends thereof, forming a bottom and a top, wherein the top comprises thermoplastic material without a carrier material, is injection moulded to the outer edge of the tube along that edge and has a pouring spout, and the bottom is quadrangular and has triangular flaps which are folded over to lie against at least one adjacent panel. In order to provide such a packaging arrangement with a particularly advantageous bottom, the invention proposes that at least two mutually oppositely disposed triangular flaps of the bottom are folded inwardly into the plane of the bottom or outwardly on to the side wall, about the lower edge between the bottom and the side wall, and fixed in that position.

7 Claims, 16 Drawing Figures

Figure 2:
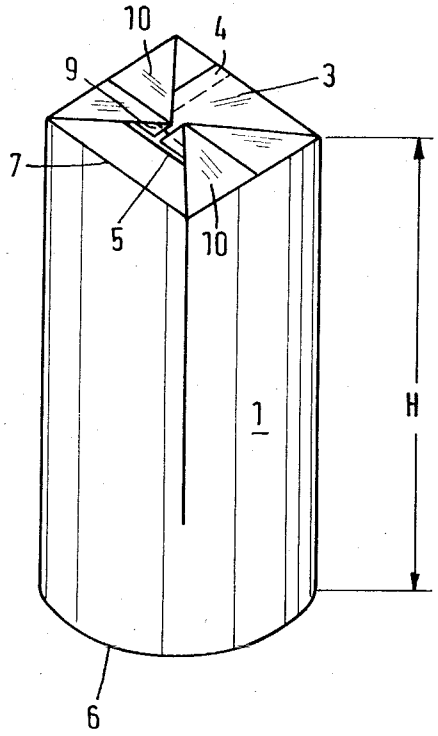

PACKAGING MEANS FOR FILLING MATERIALS WHICH ARE CAPABLE OF FLOW, HAVING A RE-CLOSABLE OPENING MEANS

The invention relates to a packing means for filling materials which are capable of flow, comprising side walls which are joined together in a tubular configuration by way of at least one longitudinal sealing seam, and end walls which are mounted to the ends of the tube, form a bottom and a top of the packaging means, one of the end walls, which forms the top, comprising thermoplastic material without a carrier material, being joined to the side walls along its outside edge by an injection process and having a pouring means which is folded inwardly of the outside contour of the packaging means, while the other end wall which represents the bottom is of a quadrangular configuration and has triangular flaps which are folded over on to an adjacent wall portion, wherein the side walls and the bottom comprise carrier material, for example cardboard, which is coated at least on one side with thermoplastic material.

That type of packaging means, which is most widely used at the present time for transporting liquids, in particular milk and fruit juices, is a parallelepipedic packaging means or carton which comprises a tubular member of carrier or backing material which is coated on both sides with plastics material and which is closed at its ends in the region of the end walls thereof by transverse closure ribs, being made into a parallelepipedic shape, so that at each end wall there are two oppositely disposed double-walled triangular flaps which initially project outwardly from the end walls of the packaging means and which are finally folded over to lie against adjacent side walls or the end walls of the package.

Many packaging means of that kind are also used for filling material in powder or grain form. In some known packaging means, the pouring opening is formed by perforated lines or other weakened lines being punched or stamped in the outer layer or ply of the packaging means, the packaging means being torn off along the perforated or weakened line after the corresponding triangular flap has been folded out into the open position.

Also known is an arrangement comprising an opening which is already punched out of the material forming the packaging means and which is fluid-tightly covered over by a strip portion. The cover strip portion is gripped and pulled up by means of a free gripping portion which is not secured to the side wall of the packaging means, thus exposing the tearopen opening, in the form of a round or elongate hole, which is disposed on the inside of the triangular flap. A disadvantage with that known arrangement is that the material is not poured out of the packaging means in the desired form of a jet or stream, in order to avoid spilling the material.

In another kind of packaging means, the attempt has been made to provide a square or rectangular slot to act as the pouring opening, the slot being covered by a closure strip portion and being disposed on one side of the end wall, beside the transverse sealing seam. However, sealing a cover strip portion quite generally involves problems, on the one hand in regard to producing a satisfactory seal and on the other hand in regard to making it easy for the cover strip portion to be torn off. Similar problems also arise when the pouring opening, which is first punched out and then closed off by the cover strip portion, is disposed in the upper wall of the triangular flap portion. Therefore, various different opening arrangements have been developed, solely in the art of parallelepipedic packaging means, wherein the transverse sealing seam which closes off the end wall is itself undone over a certain distance, or in which use is made of tearing aids, such as for example threads or cords which are welded into the arrangement.

Particularly since the increase in cost of crude oil, the manufacturers of packaging means for containing fluids are faced with the requirement of using a minimum amount of plastics material, in particular as a coating for the carrier material, and making the machine for producing the packaging means as simple as possible, as far as possible without using a cover strip portion which has to be separately sealed in position from the interior and possibly even from the exterior. In that connection, compromises had repeatedly to be accepted as between the ease of opening the packaging means, on the one hand, and a satisfactory sealing means on the other hand.

In comparison with that, British Patent Specification No. 1,389,533 discloses a packaging means for fluids, wherein the side walls also comprise cardboard which is coated with thermoplastic material, whereas the top and the bottom comprise thermoplastic material without a carrier material. When in a condition of readiness for filling, that packaging means is of such a configuration that the top is joined to the side walls by an injection process along the four edges of the top, whereas, for the purposes of filling the packaging means, the bottom is joined to the side walls by an injection process, only along one edge. Such a packaging means is inexpensive to produce, practical in design and reliable in use. In a similar way to the known parallelepipedic packaging means for liquids, which are most widely used, that known packaging means is also of an exact shape, with a high degree of stability and rigidity and with the possibility of shrink wrapping, for combined bundles.

The packaging means which is disclosed in the above-indicated publication is so-to-speak stood on its head for filling purposes; for the top which is made in one piece with the opening means is first positioned at the bottom, while the bottom which is joined to the side walls only along its one side edge, together with the open tube portion therebeside, is positioned upwardly. When producing such an opening means, there is no longer any need for complicated injection moulds for injection moulding the thermoplastic end walls in position on the side walls, and the tools may be easily pulled or pushed out of the tube portion.

After being filled, the known packaging means is closed at what subsequently forms its bottom. In that operation, difficulties may also arise in regard to centering the arrangement and producing a precisely fluid-tight weld, or at least the apparatus expenditure involved in closing the end wall which forms the bottom of the package is not inconsiderable, although the main centering work is already done by virtue of the bottom of the packaging means being secured to a side wall by the injection process.

The problem of the present invention is to provide a particularly desirable bottom in a packaging means in which the end wall which only comprises thermoplastic material forms the top or cover and the end wall representing the bottom is of a quadrangular configuration and has triangular flaps which are folded over on to adjacent panel portions. In addition, the invention seeks to provide that, while making optimum savings of material, the novel packaging means is stable and has good fluid-tight sealing properties, wherein the final consumer can easily open and reclose the novel packaging means, without particular instructions. Another aim of the invention is to provide a process for the production of such a packaging means, and an apparatus for carrying out that process.

To solve that problem, the novel packaging means is characterised in that at least two mutually oppositely disposed triangular flaps of the bottom are folded inwardly into the plane of the bottom or outwardly on to the side wall, about the lower edge between the bottom and the side wall, and are fixed in that position. By virtue of that procedure, it is easily possible to form a practical bottom which affords good stability and rigidity, which saves material, and which has good sealing properties. Due to the particular nature of the top or cover, there are also no difficulties involved in opening the packaging means, in spite of the good seal thereon.

A particularly preferred embodiment is characterised in that two oppositely disposed triangular flaps of the bottom are folded over about the lower edge right at the bottom into the plane of the bottom, and are completely covered by the adjacent bottom wall portions. Therefore, the two mutually oppositely disposed triangular flaps are displaced into the plane of the bottom of the packaging means and are then arranged substantially normal to the side walls. The portions which are still open are closed by the adjacent bottom wall portions, by virtue of their being subsequently folded down, wherein, by virtue of the bottom wall portions which are last folded down on to the plane of the bottom completely covering the folded-over triangular flaps, the arrangement provides a satisfactory closure means for covering respective halves of the bottom, with a smooth wall portion.

In that connection, it is also advantageous for the bottom to have a transverse sealing seam which extends between two oppositely disposed lower edges, between the bottom and the side wall. If, in another aspect of the invention, the transverse sealing seam is folded to form a quadruple thickness and is folded over into a flat position on the bottom, about its central fold edge which is common with the bottom, the result is a packaging means which is not only very stable but which is also practical and easy to stack, from the point of view of the user.

Another preferred embodiment of the invention is characterised in that two pairs of mutually oppositely disposed triangular flaps are folded over, to form the bottom, right at the bottom, about the respective lower edges, and the bottom wall portions which are disposed therebetween are fluid-tightly sealed together and fluid-tightly joined together at the common central point by a drop of sealing plastics material. That kind of star closure configuration presupposes not just two but four triangular flaps which are each disposed in mutually opposite pairs and which virtually form the bottom wall portion as soon as they are folded over about the lower edge into the above-mentioned bottom plane of the packaging means. In addition, except for the central point, all the edges are fluid-tight due to the effect of sealing the bottom wall portions which are between the triangular flaps. The common central point is then additionally closed in a fluid-tight manner, in accordance with the teaching of the invention, by a sealing drop of thermoplastic material.

In order for such a bottom to be of an attractive appearance, while being stable and strong, the invention further provides that the bottom wall portions which are disposed between the pairs of triangular flap portions are of a triangular configuration and are folded over on to the triangular flaps.

The invention provides a packaging means for a fluid, wherein a hitherto unusual combination of completely different closure wall portions is used at the end walls. In contrast to the known packaging means as described above, only the end wall forming the top or cover of the packaging means is to comprise purely thermoplastic material, whereas, as in the case of the conventional packaging means, the bottom is to be closed by a folded and sealed configuration; opening the hitherto conventional end wall configurations has given rise to difficulties again and again.

The combination of the two completely different end wall-producing systems is in no way obvious, especially as there are no production machines which, when using such a basic principle, promise a solution to the above-indicated problem.

With the novel principle according to the invention, namely making one end wall in the form of a purely plastics top or cover and making the bottom in the conventional quadrangular form, it is possible to produce packaging means for fluids in cube form or parallelepipedic form or in other configurations. For example, in accordance with the invention, it is desirable for the top and the cross-section of the packaging means, at least in the region of the top, to be round, and for the configuration of the top, in and directly after the injection process, to be in the configuration of use. The last-mentioned feature means that the top which only comprises thermoplastic material is injection moulded in the configuration of its ready-for-use shape. That means that, in the injection moulding process and also as far as the next processing stage, which includes for example putting the top or cover into shape, the top or cover is obviously in the position of use, that is to say, the shape thereof in which the final consumer opens the packaging means, pours or shakes out material therefrom, and possibly re-closes the packaging means. The advantage of that feature is more specifically that thermoplastic material generally tends to return to the shape in which it was injection moulded, after it has been deformed.

In contrast to that, in the known packaging means, end walls forming for example the cover or top with an opening means are injected as a complete unit in such a way that the arrangement is immediately in the appropriate form for transportation. In that case, after being filled and closed, the packaging means can be immediately transferred to a combination bundle and passed on for transportation. It has been found however, particularly in the case of household packaging means or cartons, that it is difficult to open a top which has been produced by an injection process in that way. It is substantially easier and more acceptable for example for the housewife to transform an opening means from a deformed configuration into the form in which it was manufactured by injection moulding, by pulling or pressing thereon. In the present case, directly before and then after the filling operation and during the transportation operation, the cover or top which is joined to the side walls by the injection process is folded inwardly, in respect of its opening means, in such a way that the outside contour of the packaging means is not broken by outwardly projecting parts of the opening means. Therefore, before using the packaging means, the final consumer must pull out the opening means in the cover, and that operation is considerably facilitated precisely because the thermoplastic material has in any case a tendency to return to the form in which it was manufactured by injection moulding.

The round top and the round cross-sectional configuration of the packaging means in the region of the top permit particularly simple tools to be used, but nonetheless the packaging means of the above-indicated configuration still enjoys the advantages of stability and rigidity, good utilisation of space, fluid-tightness and the possibility of being assembled in combination bundles.

It is also advantageous, in accordance with the invention, for the pouring means to have an upwardly projecting collar portion, the upper edge of which is connected to a closure stopper member having a gripping ring welded thereto, and, for transportation purposes, is disposed within the outside contour of the packaging means. The gripping ring projects somewhat from the closure stopper member in the configuration in which the arrangement was manufactured by injection moulding, so that the user can easily grip it, in order thereby to pull the pouring means up into the configuration for use, and open the opening by tearing off the closure stopper member along the upper edge of the annular collar portion. Preferably, before the opening operation, the gripping ring projects in a position in which it is turned through 180° laterally relative to the closure stopper member.

In the case of a specific form of the packaging means, it may be desirable for a bulge portion which projects from the annular collar portion to be formed in the closure stopper member at the location at which the gripping ring is connected to the closure stopper member, with the hinge of the closure stopper member being formed on the diametrically opposite side thereof. The bulge portion provides for the formation of a first small air inlet opening when the gripping ring is pulled up and after the arrangement has been moved into its configuration for use, the air inlet opening further facilitating the opening operation, that is to say, tearing off the closure member along the upper edge of the annular collar portion. Therefore, the weakened portion for tearing open and forming the air inlet opening is disposed on one side of the upper edge of the annular collar portion, while disposed diametrically opposite thereto is an increased-thickness portion which, even when the gripping ring is pulled up carelessly, does not permit the closure stopper member to be completely torn off so that the closure stopper member remains attached at the increased-thickness or enlarged portion, and is hinged as by a hinge.

In the process for the production of the packaging means, the coated carrier material is first pre-grooved, fed from a winding in web form to bending and folding stations, and drawn under tension against an outer ring to produce a tube. It is only thereafter that the tube is closed by longitudinal sealing. A number of proposed developments already provide that a tube which is subsequently closed by a longitudinal sealing operation may be produced by a process which provides that a pre-impressed web of material, after it has been suitably cut to size, is made into a tubular form by being pased through the interior of an outer ring under a tensile loading such that the web of material bears against the ring and thus takes up a circular cross-sectional shape. Now, that line of development is utilised, for the solution in accordance with the invention of the basic problem of the invention, and then the tube is desirably pulled on to a calibrating mandrel. The longitudinal sealing operation is effected, in accordance with the invention, between the mandrel and outer jaws. A respective portion of the tube is cyclically drawn off the calibrating mandrel, transfered on to a lower injection moulding tool portion and moved towards the side, out of the direction of forward feed movement, into position relative to an upper injection moulding tool portion. The cover or top is injected, being connected to the end of the tube portion, and cooled. The tube portion which is closed at one end is then drawn off the lower injection moulding tool portion. After finally the top has been pushed in, into the configuration for transportation, after the filling operation, the packaging means is closed at its bottom by a block bottom welding operation.

While, in accordance with the prior proposals, the web for forming the tube is drawn from the interior against an outer ring and thereby put into the cross-sectional shape of a circle, the present invention, by the above-indicated features, additionally provides that the tube portion formed in that way is drawn on to a calibrating mandrel. Due to the particular nature of the novel packaging means with the two different kinds of closure arrangements at the ends of the respective tube portion (corresonding to a packaging means), the filling operation is performed at a later time so that the space in the tube portion is available for the calibrating mandrel. The operation of forming the longitudinal sealing seam is effected intermittently or portion-wise between the calibrating mandrel and one or more outer jaws so that the tube portion which is to be closed along its length is arranged between the mandrel and the jaws. For the purposes of further operations, including inter alia dividing up the tube from the web into the respective portions for forming the packaging means, the tube portion is drawn off the calibrating mandrel and transferred on to another mandrel which at the same time is of a divided or split construction, to act as an injection moulding tool. In order to increase the operating speed, the length of tube portion which is produced after the dividing operation is moved out of the direction of forward feed movement and into the injection moulding machine where the end wall forming the cover or top is injection moulded on to the edge, which is still open, of the tube portion. That injection moulding process is predominantly used in the art and ensures good adhesion between the thermoplastic material of the top and the side walls which are coated with plastics material, thus also ensuring a satisfactory seal. The freshly injected top which is in the form of its configuration for use is now cooled, and the tube portion is then drawn off the lower injection moulding tool portion. That is preferably effected by means of a transportation conveyor in such a position that, after the tube portion has been pulled down off the lower injection moulding tool portion and when the top, which is now cool, is put on to the conveyor, the top is immediately pressed into its transportation configuration. In other words, after the top has been pressed into its transportation configuration, the opening means which are injected and formed in one piece together with the cover or top no longer project beyond the overall outside contour of the packaging means. At the same time, the novel packaging means is closed at its top and is disposed with the top standing on the conveyor, that is to say, so-to-speak standing on its head, with its bottom open, for further conveying movement, filling and subsequent closure. The closure operation is effected by the per se known step of welding along the transverse sealing seam in the manner of block bottom welding, to form the end wall which provides the bottom of the packaging means.

The advantage of the process according to the invention, in comparison with manufacture of the known packaging means, with the two end walls only comprising thermoplastic material, is that the closure operation, after filling of the packaging means, is a simpler one. Whereas in the known construction, the operation of connecting the three free edges of the end wall forming the bottom, by means of welding, is a difficult operation, because inter alia the components of the machine must accurately grip the packaging means and the individual tools must be produced and move with a very high degree of precision, and in addition the space within the packaging means above the level to which it is filled is very small to ensure correct engagement by the components of the machine and the welding jaws, and in spite of that an excessive air space must remain in that part of the packaging means, besides the material introduced thereinto, the steps in accordance with the present invention provides substantially better conditions and space. Although the level of liquid or the upper level of loose or bulk material introduced into the packaging means can be taken up to a desired lower edge, the level of fluid material is still sufficiently far away from the welding location that it is certain that no material in the packaging means will penetrate between the tools and the surfaces to be welded, in the transverse sealing operation. In the same way as when dealing with block bottoms, the sides are folded together at the respective edge of the tube portion, without contact with the material in the packaging means, so that the welded seam can be formed without difficulty after the folding operation. After the transverse sealing seam has cooled down, the triangular flaps are then folded over in known manner and welded to an adjacent wall portion, preferably the actual end wall that forms the bottom. It will be appreciated that, in order to carry out the block bottom forming operation and then the block bottom welding operation, the cross-sectional configuration of the packaging means in the region of that end wall which subsequently forms the bottom must be quadrangular.

On the other hand, as referred to above in connection with the description of the packaging means itself, it is highly advantageous for the end wall that later forms the top, and the adjacent cross-section of the tube portion, to be of a round configuration. If for example the major part of the tube cross-section is round as viewed in the direction of the longitudinal sealing seam or in the direction of the tube, the maximum filling volume, with respect to the packaging material used, can be achieved. In addition, with that shape, the stability or rigidity is at its best, so that even in comparison with the known parallelepipedic packaging means, the thickness of the carrier material and/or the thickness of the plastics coating on the web of carrier material can be reduced, without detrimentally affecting stability or rigidity.

The invention is advantageously further developed by the axis of the tube being in the direction of conveying movement. Although it is quite possible and even conventional practice for the axis of the tube to be disposed transversely with respect to the direction of conveying movement, manufacture of the packaging means using the novel process according to the present invention permits a higher speed of manufacture and fewer relative movements of the individual tube portions relative to each other from one operating station into the next, if the axis of the tube is in the direction of conveying movement. Tests with the apparatus according to the invention have shown particular advantages by the web of paper which is rolled on the roll, in a pre-embossed or pre-impressed form, being of such a width that it can be used to produce two or even three packaging means blanks in succession, if only two or three apparatuses for carrying out the above-described process are arranged in succession. However, that is readily possible and even desirable while still operating from one roll of paper or winding of web material, because more particularly the web is pulled by severing blades of roll-like configuration so that each of the two or three successive production apparatuses is supplied with a web having the appropriate width for producing the packaging means blanks. In that way, a machine which has two of the apparatuses described hereinafter arranged in succession may have an output of for example 3600 packaging means per hour.

According to the invention, the apparatus for carrying out the above-described process is characterised in that a calibrating mandrel is disposed in alignment with an outside shaping ring coaxially therewith, a longitudinal sealing jaw being disposed movably beside the calibrating mandrel, that, as considered in the direction of conveying movement, downstream of the longitudinal sealing jaw, there is at least one conveyor jaw, oscillating cyclically in the direction of conveying movement, while downstream of the calibrating mandrel is a cutting means, beside which there is a rotatable mandrel wheel having at least three radially outwardly projecting mandrel-like lower injection moulding tool portions, disposed at an angular spacing relative to the axis of the calibrating mandrel is an injection means with upper injection moulding tool portion, and disposed below the mandrel wheel are a conveyor having mutually spaced, upwardly open form entrainment means, a filling station and a closing station. The apparatus constructed in the above-defined manner may be installed in a comparatively small space, for all embossing or impressing, cutting and longitudinal sealing stations can be arranged upstream or downstream of guide rollers so that the calibrating mandrel can be arranged in the desired position, for example at an inclined angle of 45° relative to the horizontal, beside the mandrel wheel, and nonetheless can be easily supplied with material in the desired direction of conveying movement. In an advantageous embodiment of the invention, disposed between the coil of web material and the calibrating mandrel are one or two pairs of rollers in the form of round blades for severing the web into two or three component web portions, so that during continuous or intermittent push-type operation, the respective web of material which is drawn off the winding or coil is continuously severed to form the correct width. Further folding stations may optionally be disposed downstream of the round blades, for example for embossing or impressing edges of the packaging means.

Up til now, no reference has been made to internal protection for the longitudinal sealing seam. The station for that purpose may also be arranged upstream of a guide roller, possibly the last guide roller, before the calibrating mandrel. In that station, a sealing strip portion is applied to the subsequent inside of the coated web of paper, in the region of the subsequent longitudinal sealing seam, so that the filling material, in particular a liquid, is not faced with a surface which is uncoated, due to the cutting action at the side edge of the web of material. Otherwise, the liquid could penetrate into the cut edge which is not protected by plastics material, and thus soften the packaging means. For that reason, cover strips or sealing strip portions for the cut edge are used at that point, so that the cut edge is also coated with plastics material and the above-indicated difficulties are avoided. Downstream of that station, the coated web of paper, after being processed in the above-indicated manner, is desirably passed through a guide roller such that the web of paper, in its finished prepared form, can be fed in a position of alignment to the above-described calibrating mandrel and also coaxially with respect to the outer shaping ring.

Because, in the preferred embodiment of the machine for producing the packaging means, the individual working operations are performed intermittently and accordingly also the conveying movement of the web of paper and thus the tube portion is also performed intermittently, the apparatus has one or two longitudinal sealing jaws which are movable. The operation of sealing the longitudinal seam is effected by means of the one or more longitudinal sealing jaws which engage it from the outside, on the calibrating or shaping mandrel.

The operation of sealing the cut edges, which is referred to as LS-protection, can be effected not just by applying a suitable cover strip portion, as described above, but may also be carried out subsequently on the mandrel wheel, namely, when injection moulding the end wall which subsequently forms the top or cover of the packaging means. So that the operation of welding the longitudinal seam can be performed properly and further processing operations can be carried out in the proper positions, provided on a mandrel-like lower injection moulding tool portion is an annular abutment against which the tube portion is pushed after making the longitudinal sealing seam when pushing it down from the calibrating mandrel and transferring it on to the mandrel-like lower injection moulding tool portion. The tube portion is pushed against the annular abutment in the above-indicated manner, by means of conveyor jaws which are arranged downstream of the longitudinal sealing jaws in the direction of conveying movement, in which connection one or more conveyor jaws which oscillate with a cyclic movement may be provided at that point.

In this respect, it is advantageous, in accordance with the invention, for the conveyor means to have two conveyor jaws which are arranged diametrically opposite to each other outside the calibrating mandrel, which is of a hollow construction, the conveyor means also having an inner portion which is movable centrally between the conveyor jaws and therewith in a longitudinal slot in the calibrating mandrel. In that way, no detrimental line formed by friction occurs on the outside surface of the wall of the packaging means, preferably the side wall, more specifically, by frictionally produced tracks or traces of conveyor jaws on the side wall, because such friction does not provide for forward movement of the tube portion, but a clamping effect.

Disposed downstream of the calibrating mandrel, as viewing in the direction of conveying movement of the tube, is a cutting means which, in a particular embodiment of the invention, preferably has a rotary ring which carries cam-controlled blades arranged in a distributed configuration at its periphery. Therefore, the machine for producing the packaging means operates in such a way that first of all the longitudinal weld seam is produced on the calibrating mandrel, thereafter the tube is advanced by the length of a tube portion on to the mandrel wheel so that the longitudinal sealing seam can cool down and harden. During that movement, the next forward tube portion has been transferred from the calibrating mandrel on to the lower injection moulding tool portion, more specifically, by way of a gap at which the above-described cutting means is arranged. It will be appreciated that not later than that location, the tube must be separated or divided up into the individual tube portions or lengths, because if that is not done the mandrel-like lower injection moulding tool portion cannot be moved on the mandrel wheel laterally out of the direction of conveying movement, by a rotary motion.

The rotatable mandrel wheel which is arranged beside the cutting means has at least three and preferably eight radially outwardly projecting mandrel-like lower injection moulding tool portions which are arranged at suitable angular spacings from each other. The mandrel wheel therefore rotates cyclically in the same manner as the entire apparatus operates in a cyclic fashion. The above-described tube portion which has been cut off by the cutting means is moved by a given angular rotary movement of the mandrel wheel to a position under the injection moulding machine, in particular under the upper injection moulding tool portion, so that the lower portion and the upper portion of the injection moulding machine are precisely aligned with each other. The end wall which subsequently forms the top of the packaging means can be injected, in that condition. Such injection moulding operations are technically satisfactorily performed and in particular due to the coating, even if it is only thin, on the web of carrier material, that is to say, the upper edge of the tube portion, the plastics material applied by the injection moulding machine has very good adhesion, ensuring an absolutely sound seal between the side wall and the top or cover of the subsequent packaging means.

The mandrel wheel moves on with an intermittent motion, and thus intermittently advances the tube portion being considered, until it reaches the conveyor which is arranged preferably horizontally under the mandrel wheel. The conveyor may be one of the known chain-type conveyors which has sufficient stiffness or rigidity and strength so that the above-described abutment means, that is to say, the ring which is movable relative to the mandrel-like lower injection moulding tool portion, can strip off the tube portion in question, with the top or cover which has hardened in the meantime, and can set it in position downwardly so firmly that all parts thereof which project beyond the end line of the tube, which is normal to the axis of the tube, in particular the opening means on the top or cover, are pressed into the packaging means, in the configuration for transportation thereof. After the stripping operation, the stripping ring which at the same time was an abutment means is moved on the mandrel-like lower injection moulding tool portion, during the next intermittent rotary motion, towards the centre of the mandrel wheel, so that, after reaching the angular position described hereinbefore, it again acts as an abutment to stop the next tube portion. While that is taking place, the packaging with its top, which is initially still standing on its head, is moved into position below a piston filling means or the like by the conveyor, for example the so-called station chains, with the packaging means standing on the conveyor and having its bottom open in an upward direction. In the piston filling station or the like, the packaging means is filled with the material to be introduced thereinto. For the purposes of stabilisation and at the same time also for forming or providing the necessary circumstances for the subsequent operation of forming the block bottom, disposed on the conveyor are shaped or form entrainment means which are preferably open upwardly while in another preferred embodiment, they have at least two mutually relatively movable members which, in the condition in which they are brought together, provide a round cross-section at least in the region of one lower end and a quadrangular cross-section at the other upper end. That arrangement more specifically provides the necessary conditions for the block bottom forming operation and then the block bottom welding operation. The entrainment means are desirably mounted on the conveyor at spacings from each other in such a manner that they move along therewith and are always disposed in alignment below the mandrel-like lower injection moulding tool portions, for receiving the tube portions which are closed at one end. In addition, the entrainment means, together with the packaging means which are then open in an upward direction, are disposed in alignment below the filling station and correspondingly subsequently under the various stations for the operation of closing the end wall which subsequently forms the bottom, the operation of preparing the triangular flaps for applying them against the packaging means, and the operation of heating the triangular flaps, and under the punch or stamp member for pressing on the corners.

An advantageous embodiment of the apparatus has a cycle time of 2 seconds and eight mandrel-like lower injection moulding tool portions uniformly distributed at the periphery of the mandrel wheel. In that specific and preferred apparatus, the axis of the calibrating mandrel is inclined at an angle of 45° relative to the horizontal, and the longitudinal axis of the injection moulding tool is at an angle of 45° relative to the calibrating mandrel so that the upper and lower injection moulding tool portions are arranged substantially vertically below the injection moulding machine and, after leaving the injection moulding machine, the freshly injection moulded top or cover, from its next position in which it is turned through 45° out of the injection moulding machine, to the position in which the tube portion is stripped off and transferred into the upwardly open entrainment means on the conveyor, has a period of three operating cycles, that is to say, $3\times2$ seconds, for cooling of the top or cover, giving a total of 6 seconds.

As some of the individual components of the above-described apparatus are known per se, the apparatus for carrying out the process according to the invention can be constructed with the know-how in the pertinent art, without excessive expense. Therefore, such an apparatus can be built comparatively quickly in known installations, after suitable conversion. Various units together form the apparatus, so that replacing one unit by a corresponding different unit provides for a high capacity of adaptation in respect of the apparatus taken in general, for example to adapt it to different desired packaging configurations, round, quadratic, square or rectangular packaging cross-sections and the like. The apparatus operates satisfactorily with thinner paper for producing a packaging means of equal stiffness. The web of paper, that is to say, the carrier or backing material, only needs to be provided with a thin layer of plastics material, while nonetheless the longitudinal welding operation and also the operation of forming the transverse sealing seam can be satisfactorily carried out, for the block bottom welding operation involves a dry welding operation. Simplicity in production and the small number of construction units in the apparatus are further enhanced by the step of pre-embossing the web of material to be processed, upon manufacture thereof. The thinner coating of plastics material on the web of carrier or backing material advantageously permits a higher extruder operating speed. Many years of experience may be utilised in manufacture of the material.

Figure 1:
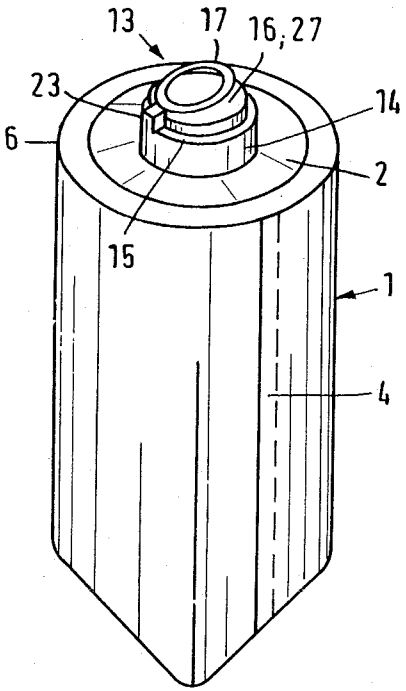
Figure 4:
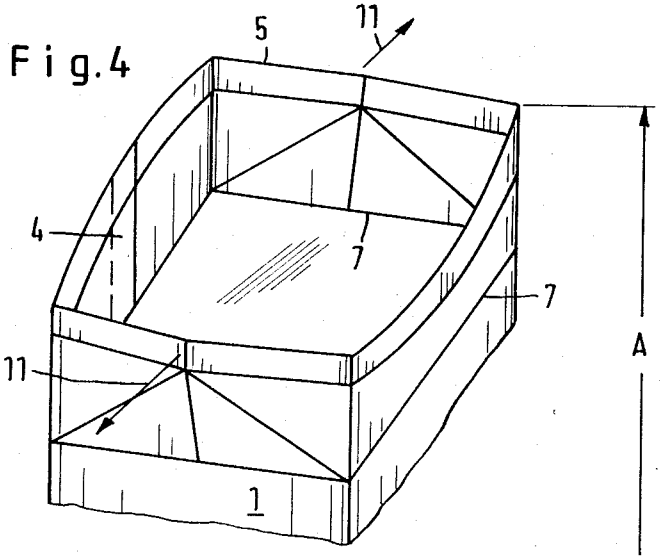
Figure 5:
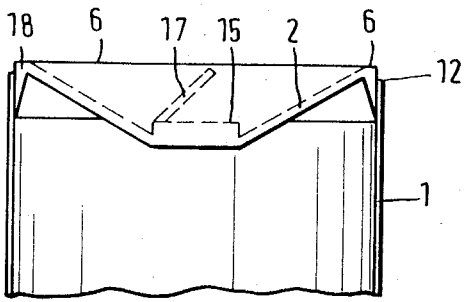
Figure 3:
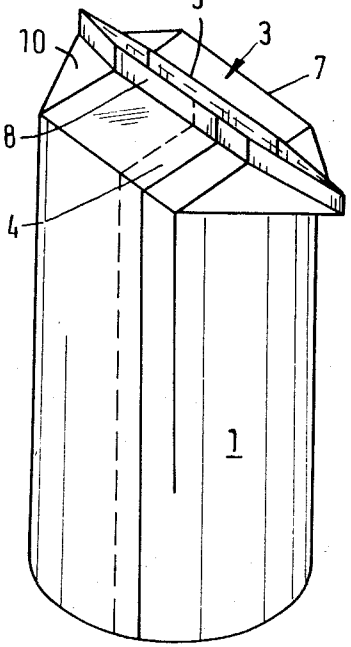
Figure 6:
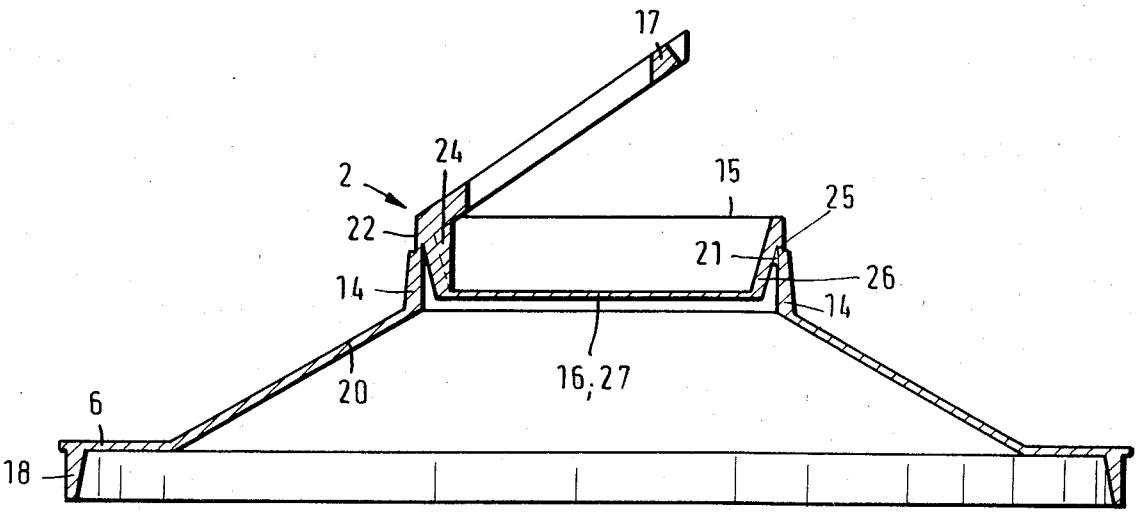
Figure 7:
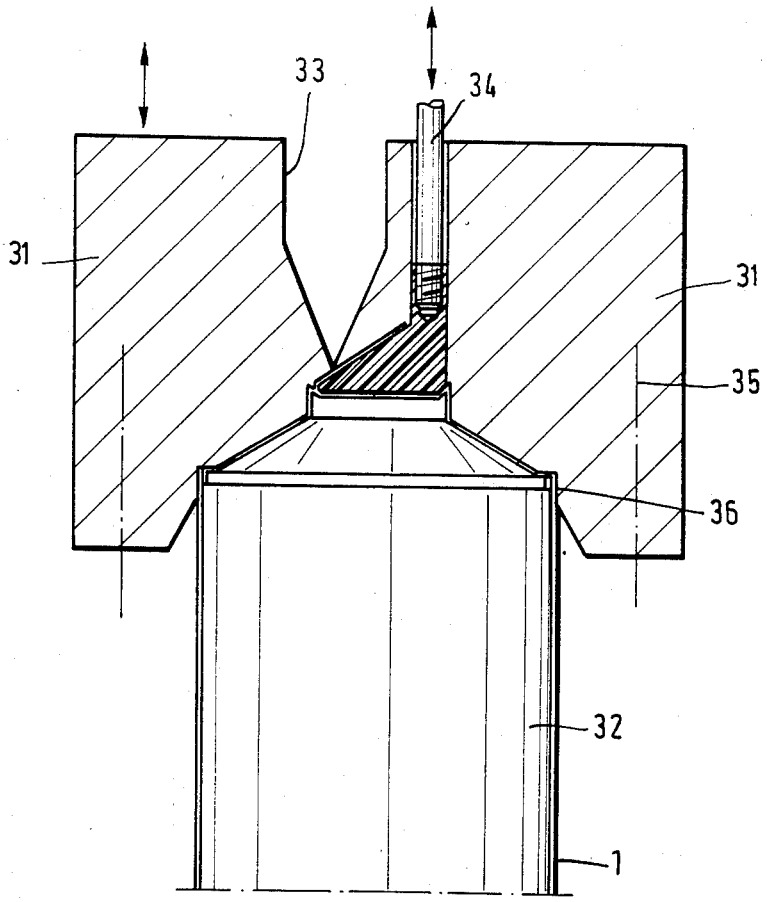
Figure 8:
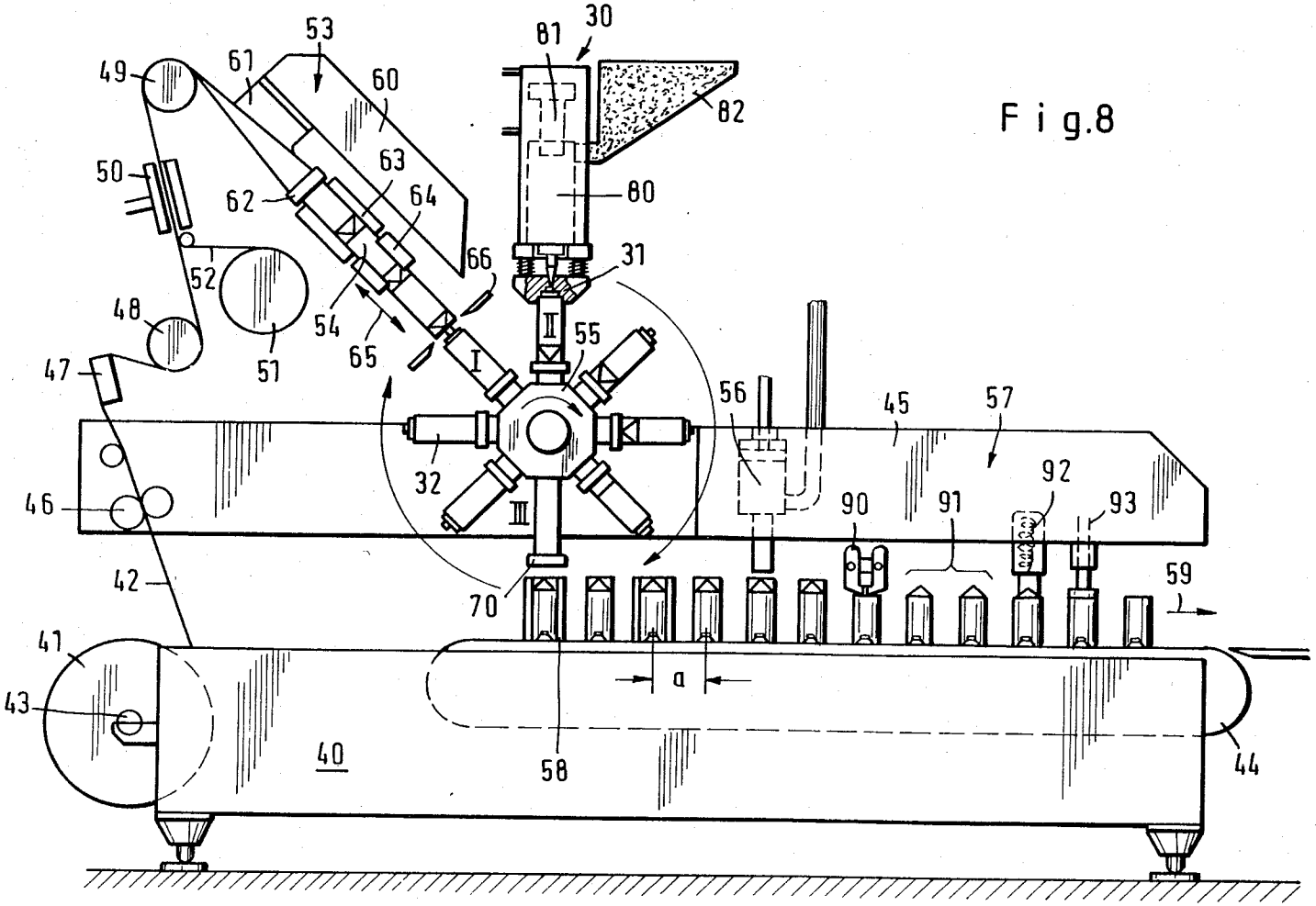
Figure 10:
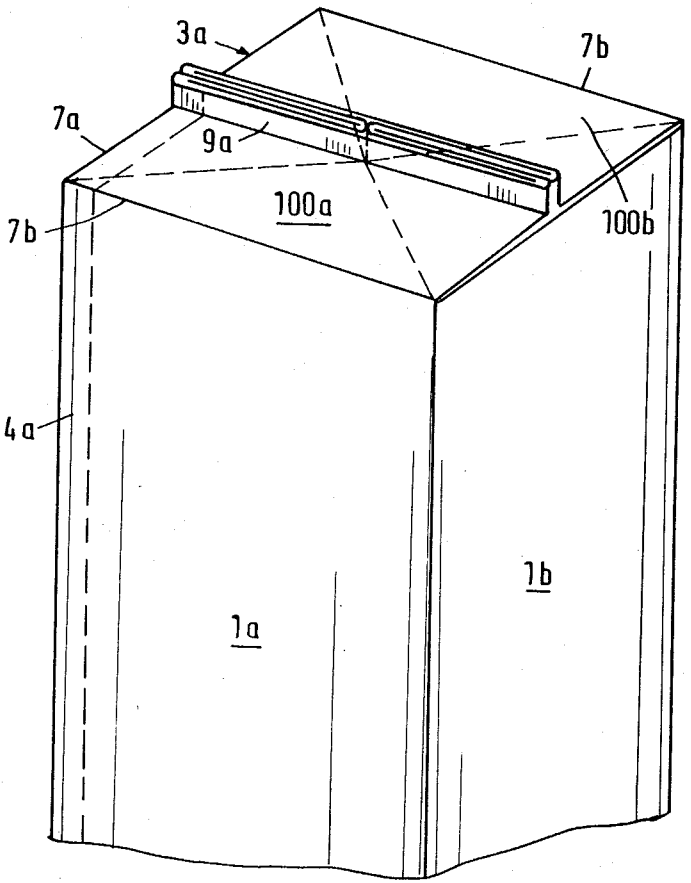
Figure 9:
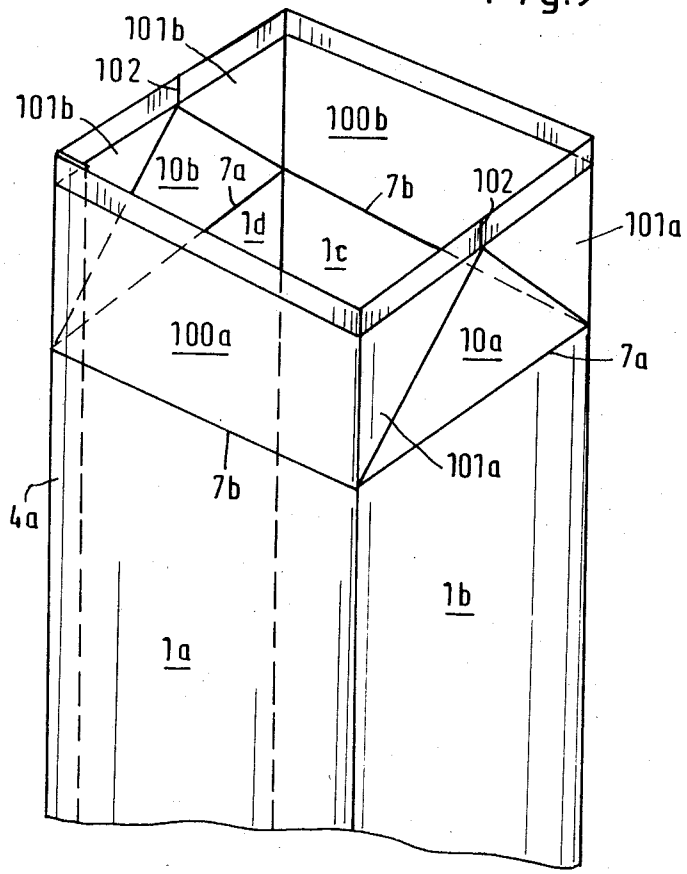
Figure 11:
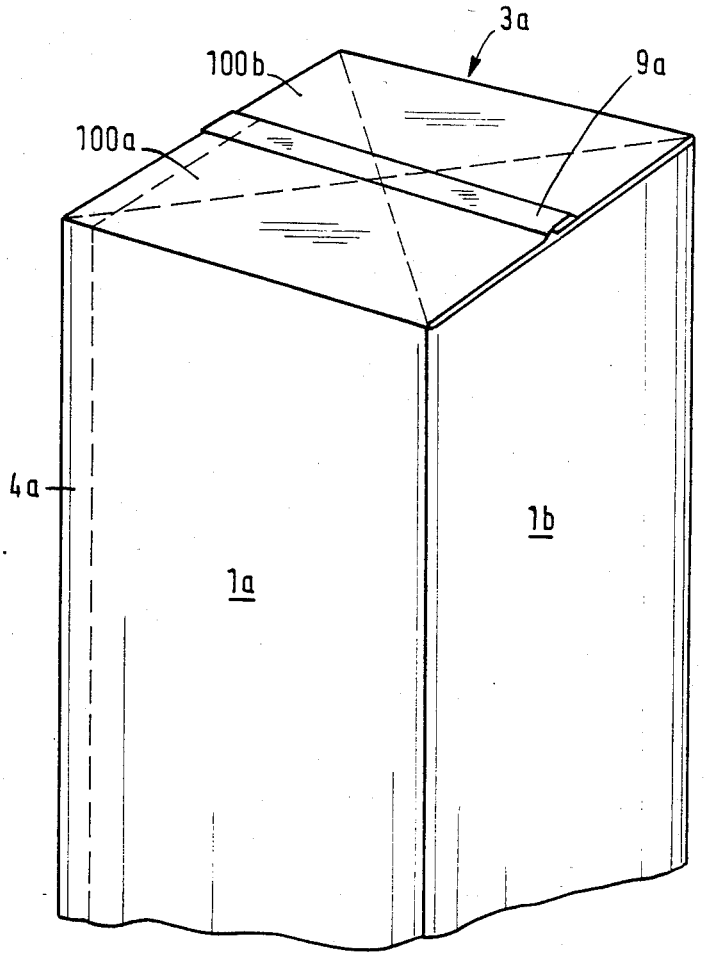
Figure 13:
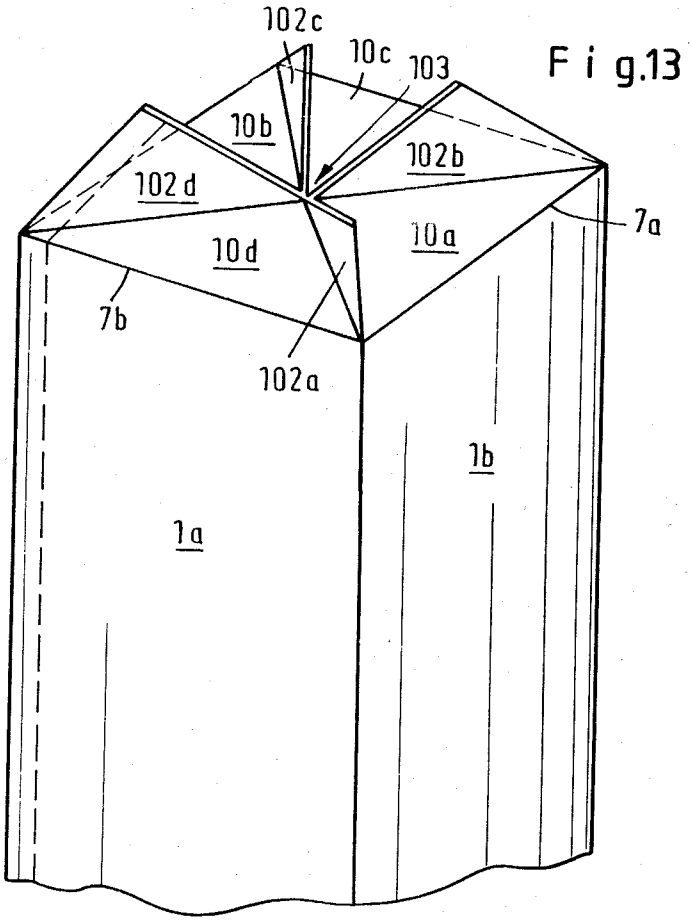
Figure 12:
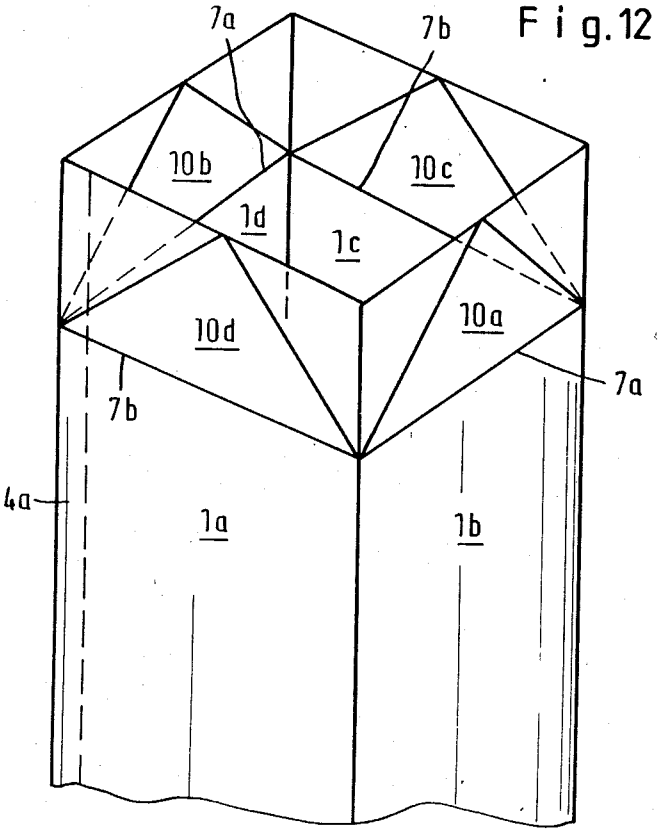
Figure 14:
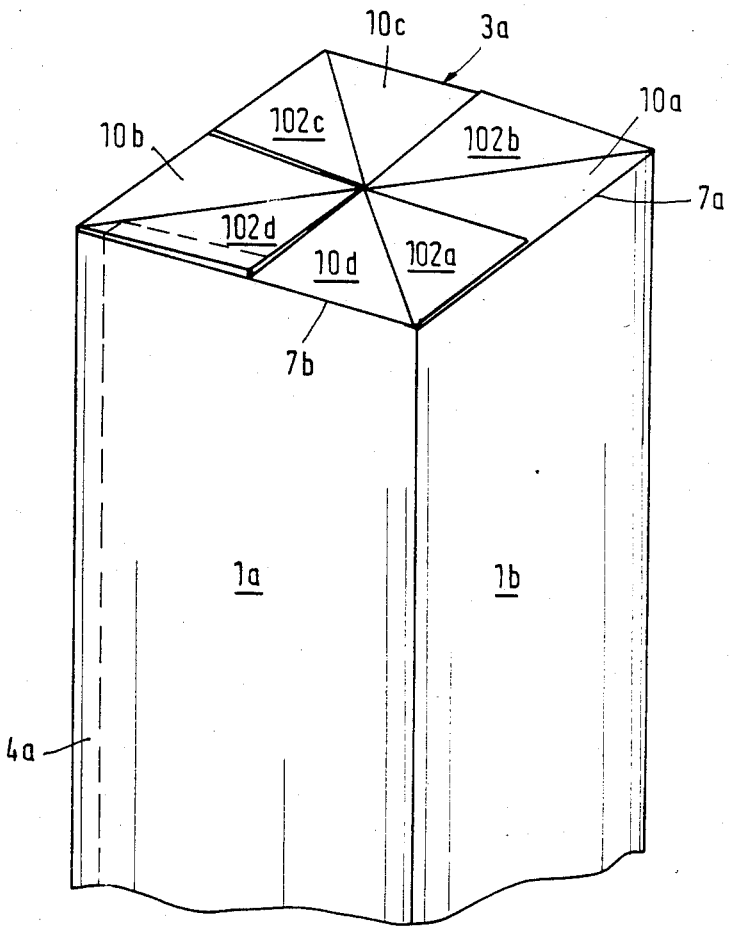
Figure 16:
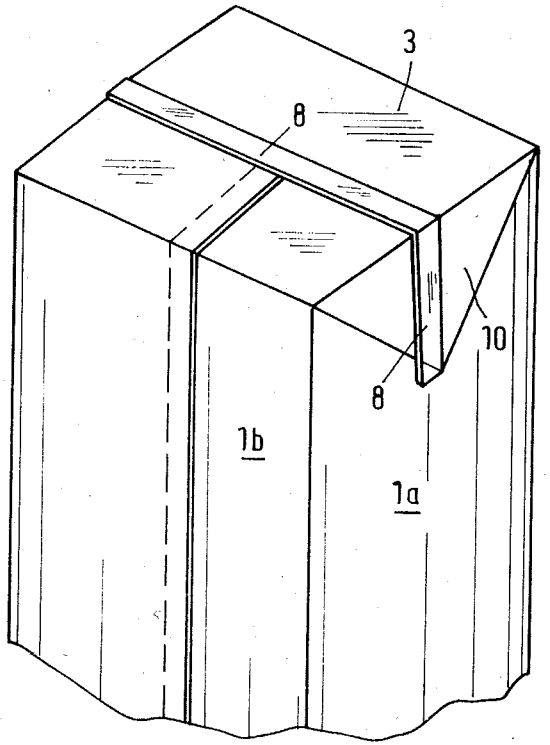
Figure 15:
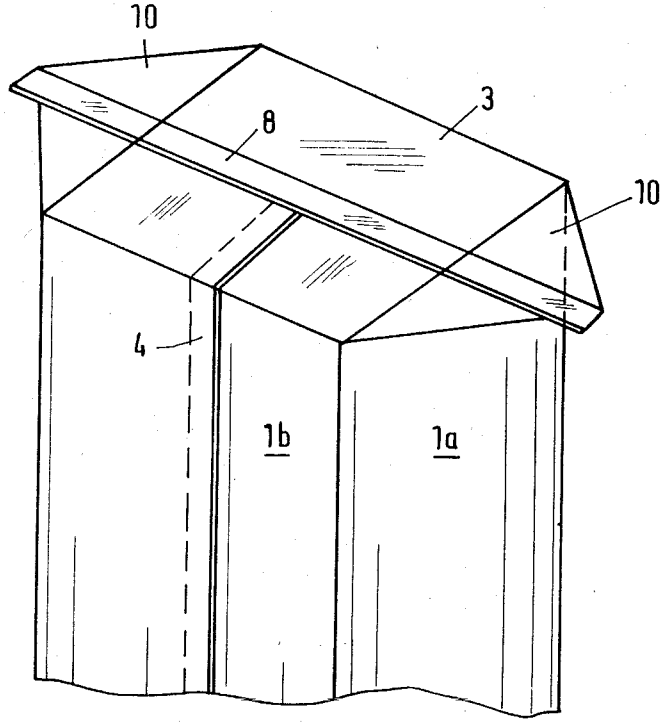

Further advantages, features and possible uses of the present invention will be apparent from the following description of a preferred embodiment, in conjunction with the accompanying drawings in which:

FIG. 1 is a perspective view of the closed package, in a condition of readiness for use, in a preferred embodiment of the invention, FIG. 2 is also a perspective view of the same packaging means but with the bottom facing upwardly, wherein the top, which is shown here at the bottom and is therefore not visible, is pressed in in such a way that no parts of the opening means project beyond the lower edge of the cover or top, beyond the outside contour of the packaging means, FIG. 3 shows a perspective view of the bottom after the step of folding the block bottom configuration and before making the transverse sealing seam, FIG. 4 shows the bottom end of the inverted packaging means, which is provided with the embossed or impressed lines for the block bottom forming operation, the bottom subsequently being formed at said upper end by the block bottom folding step, FIG. 5 is a diagrammatic cross-sectional view of the top of the packaging means in its form for transportation, in that condition in which no parts of the opening means project beyond the outside contour of the packaging means, FIG. 6 shows a side view in section through the top in the finished injection-moulded condition, but without side walls, FIG. 7 shows a sectional view of the upper and lower injection moulding tool portions of the injection moulding machine (not shown), with the packaging means shown in broken-away form, FIG. 8 is a diagrammatic view of the general construction of the apparatus for producing the packaging means according to the invention, FIG. 9 is a broken-away view of the bottom end of the tube portion with the embossed or impressed lines for the block bottom forming operation, with the triangular flaps being folded over inwardly in contrast to the outwardly folded flaps, as described with reference to FIGS. 2 to 4, FIG. 10 shows a similar view to that shown in FIG. 3, the inward folding of the triangular flaps showing the diference in relation to the outward folding of the triangular flaps as shown in FIG. 3, because in FIG. 10 the transverse sealing seam is shorter by virtue of the folding procedure employed, FIG. 11 shows the bottom of the embodiment shown in FIGS. 9 and 10, in its finished condition, wherein the transverse sealing seam is shown in the position of being laid over on to the bottom, FIG. 12 is a view similar to that shown in FIG. 9 of another embodiment of a bottom, which however has four triangular flaps, FIG. 13 shows a view similar to that shown in FIG. 10, in perspective like FIGS. 9 to 12, before finishing the bottom with the triangular bottom wall portions still standing up, FIG. 14 is a perspective view of the finished bottom, in accordance with the embodiment shown in FIGS. 12 and 13, in which the bottom wall portions have been laid over into the plane of the bottom, FIG. 15 shows an embodiment of the bottom as shown in FIG. 3, but for the triangular flops to be folded over outwardly, and FIG. 16 shows the FIG. 15 embodiment, with the triangular flaps having been folded over outwardly and there fixed in position.

Reference will first be made to FIGS. 1 and 6 to describe the packaging means or carton, then to FIGS. 7 and 8 to describe the apparatus for the production of the packaging means, and finally a possible mode of operation of the apparatus.

The finished packaging means shown in FIGS. 1 and 2, for filling materials which are capable of flow, comprises side walls which are indicated generally by reference numeral 1, because, in the embodiment illustrated herein, the packaging means is of a round crosssection in the region of the cover or top 2 (because the top 2 is also round in plan view), so that possibly a distinction could be made as between the four side walls, at the end of the packaging means at which there is the end wall forming the bottom 3. For the sake of simplicity in this description, reference will be made to the side walls 1. As shown in FIGS. 1 to 4, the side walls 1 are formed into a tubular configuration and joined along the longitudinal sealing seam 4 for the definitive formation of the closed tube. FIG. 2 shows that the longitudinal sealing seam 4 extends into the bottom 3. That is a result of the nature of the blank as can be seen also in FIG. 4. In the form shown in FIG. 2, the height H of the tube will be seen to be less than the length A of the tube portion from the free upper edge of the tube to the upper edge 6 of the top, taking into account the shaping configuration shown in FIG. 4 before the bottom 3 is in a finished condition.

The lower edge of the finished packaging means is formed by the line indicated at 7 as shown in FIGS. 2 to 4. By virtue of the various fold and embossing or impressing lines which are not referred to in greater detail herein and which are shown in FIG. 4, a double-thickness strip of cardboard 8 (see FIG. 3) is formed in the operation of forming the block bottom. Formed in the double cardboard strip 8 is the transverse sealing seam 9 which appears in FIG. 2 but which is scarcely visible. The triangular flaps 10 are also formed in that manner. The bottom 3 is produced by going from the condition shown in FIG. 4, by way of the condition shown in FIG. 3, to the condition shown in FIG. 2. First of all, the corners, the subsequent tips of the triangular flaps 10, are moved outwardly and pulled out in the direction indicated by the arrow 11 in FIG. 4, until the position shown in FIG. 3 is reached. The double-thickness strip 8 of cardboard is then pressed together, the transverse sealing seam 9 is formed, the triangular flaps 10 are folded over on to the bottom and adhesively secured in position there by for example spot heating, thereby attaining the condition shown in FIG. 2.

The above-indicated closure operation at the end of the packaging means forming the bottom 3 thereof is performed after filling the packaging means, as will be described hereinafter. At the end of the packaging means which is the lower end as viewing in FIGS. 2 to 4, in other words, the cover or top 2 is already sealed in position in a fluid-tight manner. In contrast to the quadrangular bottom 3, in the novel packaging means, the top 2 which is preferably but not necessarily of a round configuration is made only of thermoplastic material, without a carrier or backing material. Therefore, the top 2 can be injection moulded in position along the outer edge 12 of the tube or the side walls 1, as shown in FIG. 5, more specifically, in the form of its configuration of use, as shown in FIG. 1. In contrast, FIG. 5 shows the configuration of the top end for transportation, wherein the pouring means which is generally denoted by reference numeral 13 is folded inwardly of the outside contour of the packaging means in such a way that there are no individual parts of the pouring means 13 projecting beyond the outer edge 6. That ensures satisfactory stability of the packaging means and permits it to be satisfactorily packaged (by means of shrink films or the like).

The pouring means 13 is carried centrally on the top 2 in the form of an annular collar portion 14 which projects outwardly, namely, upwardly as shown in FIG. 1. The upper edge 15 of the annular collar portion 14 is provided with a closure stopper member 16 having a gripping ring 17 secured thereto.

The precise form after injection moulding of the top 2 can be clearly seen from FIG. 6. The upper edge 6 of the top 2 is virtually only a ring with a wedge-shaped support member 18 moulded on the outside thereof in such a way that the top end of the tube or side walls 1 takes up a position around the support member 18, below the edge 12 shown in FIG. 5. That provides a particularly strong and rigid join as between the top 2 and the side wall 1. Disposed between the outer edge of the top 2 and the annular collar portion 14 is a frustoconical surface portion 20 which projects outwardly in the condition shown in FIGS. 1 and 6, that is to say, in its configuration for use, while in the configuration for transportation, as shown in FIG. 5, it projects inwardly approximately at the same angle. A weakening line 22 is disposed at the top at the edge 15 of the annular collar portion 14, in an annular configuration, except for the location indicated at 21 on the right in FIG. 6. The weakening line 22 forms a weakened location which extends over almost 360°, around the closure stopper member 16 so that the closure stopper member 16 can be easily pulled out in order to open the packaging means. The location 23 (see FIG. 1) at which the gripping ring 17 is connected is disposed beside the location, which is indicated by 22 on the left in FIG. 6, on the weakening line. Beside the connecting location 23 is a bulged portion 24 which projects inwardly towards the centre from the annular collar portion 14, in such a way that the wall surface of the portion 24 extends inwardly as shown in FIG. 6 and is separated from the surrounding area only by the weakening line 22. When then the user of the packaging means tears open the weakening line 22 by pulling on the ring 27 (in an upward direction as shown in FIG. 6), then the line 22 is first ruptured in the region of the portion 24 so that air can advantageously pass into the space under the top 2.

The hinge means 25 for the closure stopper member 16 is formed in the vicinity of the location indicated at 21, diametrically opposite the portion 24, being on the right-hand side of the stopper member 16 in the view shown in FIG. 6. Accordingly, the stopper member 16 can be moved in a clockwise direction about the hinge 25 as shown in FIG. 6, that is to say, it can be rotated in the opening direction, without the stopper member 16 immediately breaking off. That arrangement advantageously provides the possibility of re-closing the packaging means, especially as the stopper member 16 has a rim portion 26 which extends substantially parallel to the annular collar portion 14 and which is only closed off by the flat bottom portion 27.

The apparatus for the production of the packaging means comprises, as a particular feature, an injection moulding machine 30 which is shown in FIG. 8, with the upper portion 31 and the lower portion 32 thereof being shown on an enlarged scale and in cross-section in FIG. 7. The construction shown in FIG. 7 will be more readily understood, once the construction of the top 2 shown in FIG. 6 has been appreciated. The precise contour of the two mutually facing surfaces of the upper and lower portions 31 and 32 is formed by machining operations to correspond to the configuration of the top 2, so that it is only necessary here to mention a few components: for example, the hopper means 33 for injection of plastics material into the cavity, the holder means 34 for the shaping press or stamp member 35 and the calibrating and sealing members 36 for sealing off the plastics material, preferably polyethylene, to prevent it from being squeezed out at the side, past the mandrel-like lower injection moulding tool portion 32. It will be readily appreciated from the view shown in FIG. 7 that a lower injection moulding tool portion 32 of one length may be replaced by a lower tool portion of a different length, without the top 2 having to be of a different configuration and the rest of the injection moulding machine having to have different parts.

The entire apparatus for production of the above-described packaging means can best be described with reference to FIG. 8. Mounted on a frame support structure 40, at the left of FIG. 8, is the winding or coil 41 of the web 42 of carrier or backing material which is thinly coated on both sides with plastics material, preferably polyethylene, being rotatably mounted in this embodiment on the bearing means 43. An endless conveyor 44 is diagrammatically illustrated on the right-hand upper half. The conveyor 44 is provided in known manner with drive means, and may be the kind of conveyor referred to as a station chain conveyor. The upper and lower runs of the conveyor 44 are horizontal and at a spacing on the right beside the coil of paper 41. Mounted at a spacing above the support structure 40 is a mounting means 45 which rotatably mounts, on the left-hand side, blades which are in the form of round blades 46 and which can be used to separate the webs of carrier material 42. Reference numeral 47 denotes a pre-bending station for forming edges of the packaging means, while disposed downstream thereof is a first guide roller 48 above which there is a second guide roller 49. Shown diagrammatically therebetween is a sealing jaw 50 with a co-operating member (not shown in greater detail), by means of which a plastic strip 52 for LS-protection, which has been drawn off a roll 51, is sealed on to the cut edge along the length thereof, so that, when the packaging means is used for containing liquids, there is no possibility, at that point, of an edge permitting direct contact between the paper and the liquid.

Between the last-mentioned LS-sealing station 50-52 and the injection moulding machine 30 which is mounted on the mounting means 45 on the right is the tube forming station 53 which is described in greater detail hereinafter. An essential component in this connection is the calibrating mandrel 54 which is hidden by the tube shown herein and which is indicated at 54 at the location of the arrangement thereof, under the tube. The axis of the calibrating mandrel 54 is disposed at an angle 45° to the horizontal. Disposed in alignment therewith, in a downward direction and towards the right, is the mandrel wheel which is generally indicated by 55 and which has the eight mandrel-like lower injection moulding tool portions 32. Further to the right of the mandrel 55, on the mounting means 45, is the piston filling device 56, while further to the right, beside the piston filling device 56, is the block bottom welding station which is only diagrammatically shown, being generally indicated at 57.

Finally, a form entrainment means 58 is shown in diagrammatic form only at two locations, on the upper run of the conveyor 44. Each entrainment means 58 is mounted on the conveyor 44 at a spacing a from the respective adjacent entrainment means, and, with the conveyor 44, is moved below the block bottom welding or closure station 57, in the direction indicated by the arrow 59.

More specifically, the tube forming station 53 comprises a holder 60 which is also arranged at an angle of 45° to the horizontal and to which the forming or calibrating mandrel 54 is secured, by way of the mandrel curved portion 61. The coated web 42 of paper is laid around the curved portion 61, on the right, below the guide roller 49, in the form of a downwardly open shell configuration. The bottom right end of the shell configuration, in a tensile stress condition, lies within and against the outer ring 62 which is also disposed coaxially with respect to the calibrating mandrel 54. Downstream of the ring 62, in the direction of conveying movement which is to be considered in this case as from the guide roller 49 downwardly towards the right towards the mandrel wheel 55 at an angle of 45°, there is a longitudinal sealing jaw 63 and, at a further spacing downstream thereof, a conveyor jaw 64. The latter oscillates at the operating rate of the entire apparatus, as indicated by the double-headed arrow 65. The calibrating mandrel 54 also extends onward in the direction of conveying movement by a tube portion length A, namely, to the cutter means 66 which is diagrammatically indicated herein in the form of two blades, but which in actual fact may be a round blade with an inwardly disposed co-operating blade, for producing a shearing effect.

From the functional point of view, the mandrel wheel 55 is disposed downstream of the tube forming station 53. It is rotatable in the direction of the arrow indicated, that is to say, in the clockwise direction, about the central axis, more specifically, cyclically, that is to say, intermittently, each cycle advancing a mandrel-like lower injection moulding tool portion 32 by 45° in the clockwise direction. Each lower tool portion 32 carries an annular abutment 70 which is driven with an oscillating movement in the axial direction of the mandrel-like lower injection moulding tool portion 32, to produce a stripping effect. In the lowermost position indicated at III, the abutment or stripper ring 70 is in its lowermost position.

Vertically above position III, that is to say, at the position indicated by II, the respective lower injection moulding tool portion 32 is disposed perpendicularly below the injection moulding machine 30, as in the case of the arrangement illustrated in FIG. 7. The upper injection moulding tool portion 31 can be moved vertically upwardly and downwardly with a stroke movement (so that it can be lifted away from the respective lower portion 32, releasing the freshly injected top 2), with the stroke movement being greater than the oscillation stroke movement of the injection cylinder 80 with metering punch or ram member 81 and granulate container 82. There appears to be no need for a more detailed description of the injection moulding machine 30, and likewise in regard to the closure station 57 having the means 90 for closing the bottom end of the packaging means, the means 91 for preparing the triangular flaps 10 to be applied to the bottom 3, the means 92 for heating the triangular flaps 10 and the means 93 with the pressing punch members for pressing the triangular flaps 10 into place. The packaging means shown on the top run of the conveyor 44 is so-to-speak standing on its head; for it will be seen that the cover or top 2 is downward, while the end wall which subsequently forms the bottom 3 of the packaging means is upward. For that reason, after the packaging means, once it has been filled and closed to put it into a finished condition, has been conveyed away in the direction indicated by the arrow 59, the packaging means is turned over so that the top end is upward.

The machine is operated in such a way that the web 42 of paper is severed for example by the round or roller blades 46 into three separate juxtaposed webs which are each fed to the same apparatus, as generally shown in FIG. 8. However, a description of the mode of operation of a machine is sufficient for appreciation of the mode of operation and the process according to the invention. The paper web 42 is pre-bent by the means 47 into the edges which have not yet been preembossed, then diverted by the roller 48 and passed into the edge protection station 50 where the plastics strip portion 52 which is drawn off the roller 51 is sealed by means of the sealing jaw 50 over the cut edge at the edge of the web 42, where it is not coated with plastics material. When the web of paper has been prepared in that manner, it is diverted downwardly and towards the right by means of the guide roller 49, in such a way that the direction of conveying movement is now from the upper outside periphery of the guide roller 49 along the axis of the calibrating mandrel 54 towards the centre of the mandrel wheel 55. By virtue of the tensile stress which is produced by the conveyor jaws 64, the paper web 42 is initially applied in a semicircular configuration around the mandrel projection portion 61, with the web 42 in a downwardly open shell configuration, in order then completely to enclose the calibrating mandrel 54, bearing internally against the outer ring 62. That step of causing the web of paper to enclose the calibrating mandrel 54 produces the tubular configuration and takes place in such a way that the two free edges of the tube overlap each other by a certain amount so that the longitudinal sealing seam 4 can be formed at the overlap region by means of the sealing jaws 63. During the sealing operation, the tube portion which is of the length indicated at A is stationary. After the sealing jaw 63 is opened, the conveyor jaws 64 pull the next forward tube portion towards the mandrel wheel 53, over a tube portion length A, whereby the tube portion in question, on which the longitudinal sealing seam has just been formed, moves to the bottom right end of the calibrating mandrel 54. At that point, the tube is now severed by means of the cutter device 66 from that part which has just been pushed on to the mandrel-like lower injection moulding tool 32, in such a position as to bear against the abutment 70, by virtue of the action of the conveyor jaws 64, as last described above.

In the next operating cycle, the tube portion in question is pushed through the cutter device 66 on to the mandrel-like lower injection moulding tool portion 32, in position I. The lower portion 32 is of a diameter which is about 0.5 mm less than that of the calibrating mandrel 54.

The mandrel wheel 55 now rotates through a further cycle, that is to say, 45° in the clockwise direction, so that the tube portion in question now reaches station II under the injection moulding machine 30. The upper injection moulding tool portion 31 now moves into the position shown in FIG. 7, being engaged around the upper edge of the tube or the side wall 1. In that way, the top 2 is injection moulded directly on to the upper edge 12 of the side walls 1. The upper injection moulding tool portion 31 or the further injection moulding mandrel 35 then moves away from the top 2 and the mandrel wheel 55 can then move through 180°into position III, while at the same time the top with the fresh injection moulding is cooled.

The mandrel wheel 55 is so adjusted, and synchronised with the other stations 53, 30 and with the entrainment means 58, that the arrangement provides precisely coincident positions as between the axes of the oppositely disposed components in the individual stations, in particular stations I, II and III. In station III, the annular abutment 70 acts as a stripping means and pushes the tube portion in question, which is closed at one end by the top 2, downwardly towards the conveyor 44, more specifically, into the entrainment means 58. In the embodiment as shown in FIG. 1, that is to say, with a round top and a quadrangular bottom, it is initially in an open condition, in order to allow the top 2 which projects out further or which is larger in area, to pass, and then closes down to the smaller quadrangular configuration. When the packaging means is pushed down, the ring 70 pushes the top 2, by means of the stiff side walls 1, on to the upper run of the conveyor 44 in such a way that the top 2 is folded into the transportation configuration shown in FIG. 5. That inward folding movement of the top 2 does not give rise to any difficulties because the packaging means is still empty.

The station chain conveyor 44 now conveys the inverted packaging means which is still open at the bottom and ready to be filled, towards the right, in the direction indicated by the arrow 59, with one entrainment means 58 being at a distance a from the next. The packaging means passes below the filling station 56 which is in the form of a piston-type filling means, and is filled up to the lower edge 7. In the means 90, the bottom of the packaging means is closed by going from the condition shown in FIG. 4 into the condition shown in FIG. 3. Then, after the transverse sealing operation, in the diagrammatically indicated means 91, the triangular flaps 10 are prepared for being folded into place, heated in the station 92, and adhesively secured to the bottom 3 by way of pressure punch means, in the station 93, so as to produce the configuration shown in FIG. 2.

Depending on the configuration of the block bottom closure, the above-mentioned triangular flaps may be folded over on to the bottom itself or on to a side wall.

Disposed at the opposite end is the cover or top which is only made of thermoplastic material and the annular collar portion of which may be of a round, oval, polygonal or like configuration, and projects in an outward direction. In the case of the frustoconical configuration of the top as shown in the drawings, it is desirable for the annular collar portion to be disposed at a central position. In the case of different forms of covers however, it is entirely possible for the annular collar to be disposed towards the side, closer to the edge, so that when pouring out the packaging means, the pouring edge has to come closer to the edge of the top of the packaging means.

After the top has been folded from the configuration in which it was produced by injection moulding, into the transportation configuration, all parts of the opening means, that is to say, including also the gripping ring which is welded in position, preferably lie within the outside contour of the packaging means because that gives the optimum configuration for transportation purposes. The embodiment illustrated in the drawings has a gripping ring which extends upwardly at an inclined angle of 30° and which is moulded on the closure stopper member. However, an embodiment which is not illustrated in the drawings and in which the gripping ring is injected moulded in a position of being turned through 180° is particularly desirable. In other words, the main plane in the gripping ring is parallel to the outer edge of the packaging means or parallel to the plane which extends through the edge of the top of the packaging means. However, the gripping ring is still always within the outside contour of the packaging means, in its transportation configuration. Arranging the gripping ring in the position in which it has been rotated out of the closure stopper member through an angle of 180° is advantageous for the reason that in that way the injection mould for producing the top of the packaging means can be of a simpler form.

The foregoing description shows that the choice of the form of cover or top, according to the injection moulding tool, may be subject to certain variations. For example, the pouring opening could be formed on a concertina-like or accordion-like arrangement. The main consideration is the 'undercover form' for transportation of the packaging means and the 'above cover form' for pouring out the contents of the packaging means. In particular for the cover which only comprises thermoplastic material, the invention makes it possible to provide a large number of desired opening arrangements and in that respect also to make use of the possibility of cold deformation in order for the cover or top to be of various forms, for example the optimum form for transportation on the one hand and the optimum form for pouring out the contents of the packaging means, on the other hand. Cold deformation can be interpreted in this sense as pressing the top or cover into the configuration for transportation or pulling it out into the configuration for use.

Reference will now also be made to the other two embodiments of the bottom configuration of the packaging means as shown in FIGS. 9 to 11 on the one hand, and FIGS. 12 to 14 on the other hand.

In the embodiment shown in FIGS. 9 to 11, it will be seen that the end walls 1*a*, 1*b*, 1*c*, and 1*d* are connected in a tube-like configuration by a longitudinal sealing seam 4*a* produced at one corner. Due to the broken-away views of the tube in FIGS. 9 to 14, the bottom 3*a* can be seen only in FIGS. 10 and 11 on the one hand and in FIG. 14 on the other hand.

Between the side walls portion 1*b* and 1*d* and the triangular flaps 10*a* and 10*b* can be seen the lower edge 7*a* with the further lower edges 7*b* which are respectively adjacent thereto or disposed therebetween and which extend normal thereto. In addition, fold edges which are provided for forming the transverse sealing seam 9*a* as shown in FIGS. 10 and 11 are provided around the tube, at the level of the tips of the triangular flaps 10*a* and 10*b*. Above the lower edges 7*a* and 7*b*, the area extending around the tube, besides being formed by the triangular flaps 10*a* and 10*b*, is also formed by two mutually oppositely disposed adjacent bottom wall portions 100*a* and 100*b* and four triangular panels 101*a* and 101*b* which are also disposed opposite to each other.

When now the illustrated configuration is folded into a block bottom form, the two oppositely disposed triangular flaps 10*a* and 10*b* are first folded inwardly about the lower edges 7*a*, that is to say, they are folded down in directions towards each other, so that the two short fold edges 102 move towards each other and remain closely adjacent to each other, as can be seen from the perspective plan view shown in FIG. 10. The adjacent bottom wall portion 101*a* and 101*b* respectively are also entrained with the triangular flaps 10*a* and 10*b* when they are folded down, and thereby simultaneously also entrain the two adjacent square or rectangular bottom wall portions 100*a* and 100*b* in such a way that the latter finally take up the positions shown in FIG. 10. When then the transverse sealing seam 9*a* is also folded over on to the surface of the bottom 3*a*, the arrangement takes up the final position as shown in FIG. 11.

A similar bottom configuration is also to be found in the other embodiment as shown in FIGS. 12 to 14. Many lines and panel portions are similar to those in the embodiment shown in FIGS. 9 to 11, so that a briefer description is adequate at this point. FIG. 12 again shows the two oppositely disposed triangular flaps 10*a* and 10*b*, which are also to be seen in FIGS. 13 and 14, to show the star-like arrangement thereof. However, this embodiment also has two further oppositely disposed triangular panel portions, namely those which are indicated by reference numerals 10*c* and 10*d*. They can also be seen in FIGS. 13 and 14. The triangular bottom wall portions which are disposed therebetween, of which there is a total of eight, are not designated by reference numerals in FIG. 12. When the triangular flaps 10*a*, 10*c*, 10*c* and 10*d* are folded in however, they form double-thickness triangular bottom wall portions which are shown in FIGS. 13 and 14, being designated by reference numerals 102*a* to 102*d*.

FIG. 13 shows that the common central point 103 can be readily sealed in a fluid-tight manner by a drop of plastics sealing material, which is not shown in the drawing. At the same time, that also joins the four triangular flaps 10*a* to 10*d* together.

The embodiment shown in FIGS. 15 and 16 corresponds to that shown in FIGS. 1 to 4, but has triangular flaps 10 which are bent over outwardly on to the side walls 1a where they are sealed in position. Moreover, the components shown in FIGS. 15 and 16 bear the same reference numerals as in FIGS. 1 to 4. This manner of folding the arrangement serves for additionally stiffening the lower part of the packaging means and thus provides enhanced stability.

What is claimed is:

1. In a container to be filed with materials which are capable of flowing comprising a side wall of a sheet of carrier material coated with a thermoplastic material, and having longitudinal edges joined at a longitudinal seam to form a generally tubular body; a bottom formed by folding a bottom portion of said side wall at a fold line in the side wall, and in a plane transverse the axis of the tubular body, the bottom including a plurality of triangular flaps defining a quadrangular configuration and folded over to lie against at least one adjacent panel portion of the transversely folded bottom portion of said side wall, and a top disposed at a top edge of the tubular body, said top being formed of said thermoplastic material and affixed onto said top edge by injection molding the top onto said tubular body; the improvement wherein at least two of said flaps disposed opposite each other are folded inwardly at said fold line to lie along the plane of said bottom against said panel portion of said bottom portion and are affixed in such position, and wherein wherein said bottom has a transverse sealing seam extending at least between said fold lines and to the apexes of said oppositely-disposed, inwardly folded triangular flaps.

2. In a container to be filled with materials which are capable of flowing comprising a side wall of a sheet of carrier material coated with a thermoplastic material and having longitudinal edges joined together at a longitudinal seam to form a generally tubular body; a bottom formed by folding a bottom portion of said tubular body side wall at a fold line in the side wall, and in a plane transverse the axis of the tubular body, the bottom including a plurality of triangular flaps defining a quadrangular configuration and folded over to lie against at least one adjacent panel portion of the transversely folded bottom portion of said side wall; and a top disposed at a top edge of the tubular body, said top being formed of said thermoplastic material and affixed onto said top edge by injection molding the top onto said tubular body; the improvement wherein at least two of said flaps disposed opposite each other are folded outwardly at said fold line to lie against the side wall, and are affixed in such position, and wherein said bottom has a transverse sealing seam extending at least between said fold lines and to the apexes of said oppositely-disposed, outwardly-folded triangular flaps.

3. A container according to claim 1 or claim 2, wherein said top has a pouring spout and a generally concave wall extending from the top edge of the side wall to said pouring spout so that the latter is disposed, in a transport position, below a top plane of the container.

4. A container according to claim 1 or 2, wherein said sealing seam is formed of two layers of said sheet joined together and extending from the apex of one of said oppositely-disposed triangular flaps to the apex of the other thereof.

5. A container according to claim 1 or 2, wherein there are two pairs of mutually oppositely disposed triangular flaps folded inward at the respective fold line at said bottom edge, to lie against a respective one of said panel portions to define said bottom, said flaps and panel portions being sealed fluid-tight against one another and joined fluid-tight at a common central point by a drop of sealing plastics material.

6. A container according to claim 1, or claim 2, wherein said top and the cross section of said tubular body at least in the vicinity of said top edge are round.

7. A container according to claim 3, wherein said pouring spout has an upwardly projecting annular collar, an upper edge of which is fitted with a closure stopper member having a gripping ring member formed onto it, and wherein, in said transport position, the gripping ring is substantially disposed below said top plane.

* * * * *